United States Patent [19]

Hosking et al.

[11] Patent Number: 4,867,431

[45] Date of Patent: Sep. 19, 1989

[54] SHEET FEEDING APPARATUS

[75] Inventors: Steven M. Hosking; Simon G. Calverley, both of Portsmouth, England

[73] Assignee: De La Rue Systems Ltd., England

[21] Appl. No.: 297,983

[22] Filed: Jan. 17, 1989

Related U.S. Application Data

[63] Continuation-in-part of Ser. No. 95,043, Sep. 9, 1987, Pat. No. 4,813,658.

[30] Foreign Application Priority Data

Sep. 10, 1986 [GB] United Kingdom ..... 8621841

[51] Int. Cl.[4] ..... B65H 5/06

[52] U.S. Cl. ..... 271/3; 271/110; 271/176; 271/303; 271/902

[58] Field of Search ..... 271/110, 111, 3, 122, 271/303, 176, 902

[56] References Cited

U.S. PATENT DOCUMENTS 4,621,799 11/1986 Bastow ..... 271/110 X 4,667,951 5/1987 Honjo ..... 271/902 X

*Primary Examiner*—Richard A. Schacher

*Attorney, Agent, or Firm*—Ostrolenk, Faber, Gerb & Soffen

[57] ABSTRACT

Sheet feeding apparatus such as a cash dispenser comprises a first transport system having feed rollers (5), separation rollers (6), and a contra-rotating roller (7); a second transport system comprising a pair of belts (11, 12); and a diverter (25) positioned between the two transport systems. The diverter is movable between a first position in which sheets may be conveyed from the first transport system to the second transport system and a second position in which sheets may be conveyed upon reverse movement of the second transport system past the diverter (25) and away from the first transport system. The diverter is biassed towards its second position and is movable towards its first position in response to engagement of the diverter by a sheet fed towards the diverter by the first transport system.

The first transport system withdraws sheets from a store (1) having a lid (34) which provides a dump into which rejected sheets are fed upon reverse movement of the second transport system.

8 Claims, 2 Drawing Sheets

SHEET FEEDING APPARATUS

This is a continuation-in-part application of U.S. Ser. No. 095,043 filed on Sept. 9, 1987 and assigned to De La Rue Systems Limited now U.S. Pat. No. 4,813,658.

FIELD OF THE INVENTION

The invention relates to apparatus for feeding sheets, in particular banknotes, security documents and the like.

DESCRIPTION OF THE PRIOR ART

A variety of sheet feeding apparatus is currently available which is adapted to withdraw sheets such as banknotes from a store and feed them to a dispense outlet. In general, a sheet store is mounted in the apparatus and sheets are withdrawn, usually singly from the store. Most feeding apparatus of this type includes means to prevent more thanone sheet being fed to the dispense outlet. However, the withdrawal system often causes more than one sheet to be moved at least partially out of the store. This is desirable when it is desired to remove the store since the protruding sheets may be left in the apparatus when the store is withdrawn or, in the case where the dispense outlet of a store is automatically closed on withdrawal of the store, could prevent closure of the dispense outlet. Where the sheets comprise banknotes or other security documents, this is particularly undesirable.

U.S. Pat. No. 4,651,982 discloses a simple sheet feeding apparatus but which is quite bulky leading to an unacceptable size for the apparatus in certain applications.

SUMMARY OF THE INVENTION

In accordance with the present invention, we provide sheet feeding apparatus comprising a sheet store having a lid in which is provided a sheet dump; first transport means operable in a forward direction to withdraw sheets from said sheet store; second transport means arranged to receive sheets from said first transport means and operable in a forward direction to feed said sheets to an output position, sad second transport means being reversible to feed sheets to said dump provided in said lid of said sheet store; drive means for driving said first and second transport means; detection means for detecting the passage of sheets; and control means for controlling operation of the apparatus during a sheet dispense operation so as to cause said first transport means to withdraw a single sheet from said store, for monitoring said detection means to determine whether a single sheet has been correctly fed, and for causing said second transport means to feed correctly fed sheets in said forward direction to said output position, and to feed incorrectly fed sheets in said reverse direction to said dump while preventing further sheets from being fed to the second transport means during said reverse movement of said transport means.

This apparatus deals with the problems outlined above by providing the sheet dump in the lid of the store.

Preferably, the appratus further comprises diverting means cooperating with the second transport means to assist sheets fed by the second transport means to pass to the dump.

The invention is also particularly useful where the apparatus further comprises a sheet store housing adapted to cause a dispense outlet of a store to open when the store is moved into the housng and to close when the store is withdrawn from the housing. In this case, a protruding sheet would prevent the dispense outlet from closing and the apparatus of the invention can be used to cause such sheets to be fed back into the store before the store is withdrawn.

To this end, the control means preferably causes reverse movement of the second transport means for a predetermined period at the end of a dispense operation.

Preferably the control means also causes reverse movement of the second transport means when a feed fault (such as feed failure, jam, or double dispense) is detected in order to reject misfed sheets.

Conveniently, the first transport means comprises at least one movable friction surface for engaging the leading sheet in the store and for withdrawing the sheet from the store when the first transport means is operated in the forward direction. The or each movable friction surface would typically be defined by the surface of a roller although a surface defined by a belt could also be used.

The sheet feeding apparatus according to the invention is particularly suitable for use with a cash dispenser, particularly a cash dispenser for dispensing a single denomination of banknotes.

BRIEF DESCRIPTION OF THE DRAWINGS

In order that the invention may be better understood, an embodiment of a cash dispenser according to the present invention will now be described with reference to the accompanying drawings, in which.

DETAILED DESCRIPTION OF AN EMBODIMENT

Figure 1:
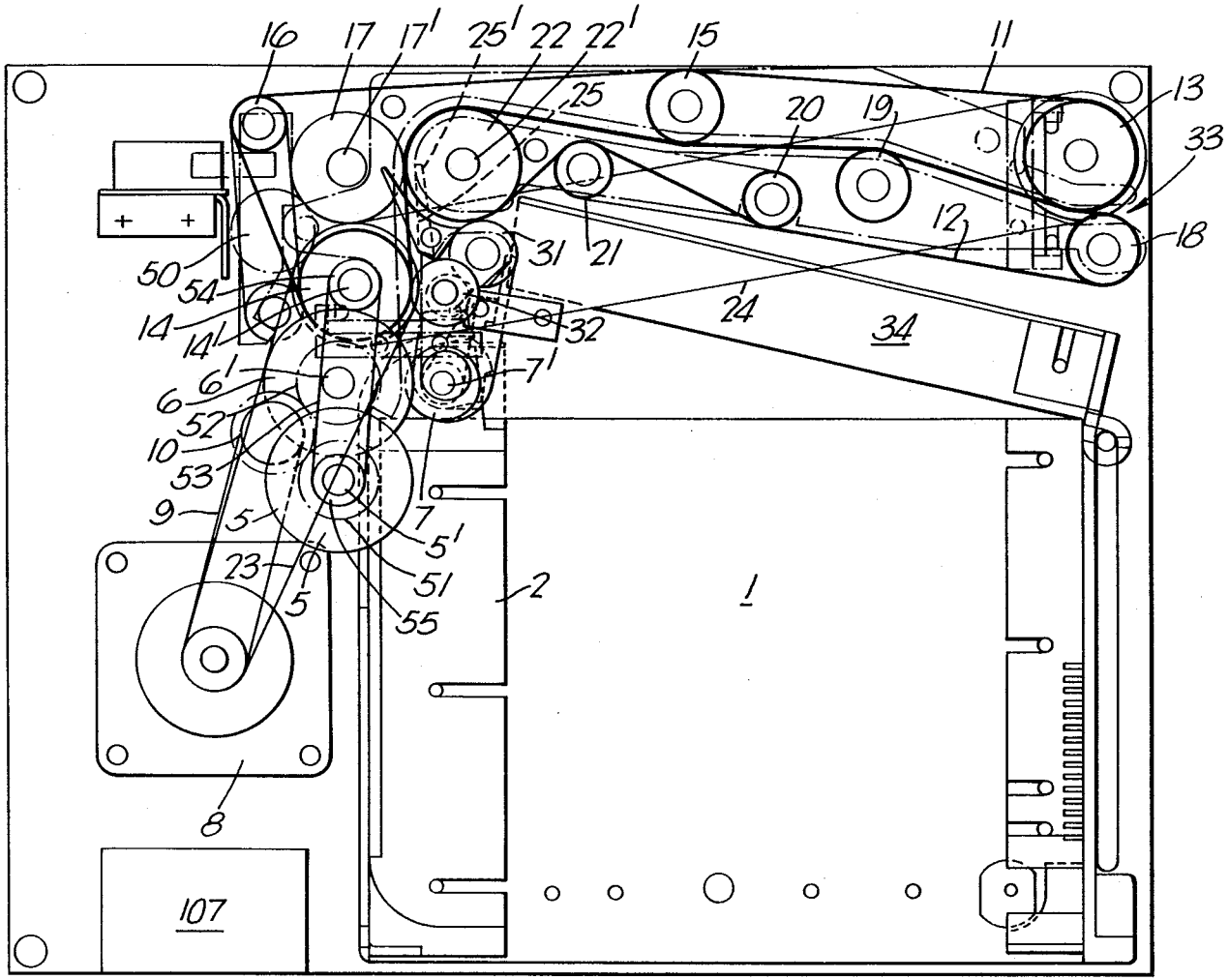
FIG. 1 is a side view of the dispenser.
Figure 2:
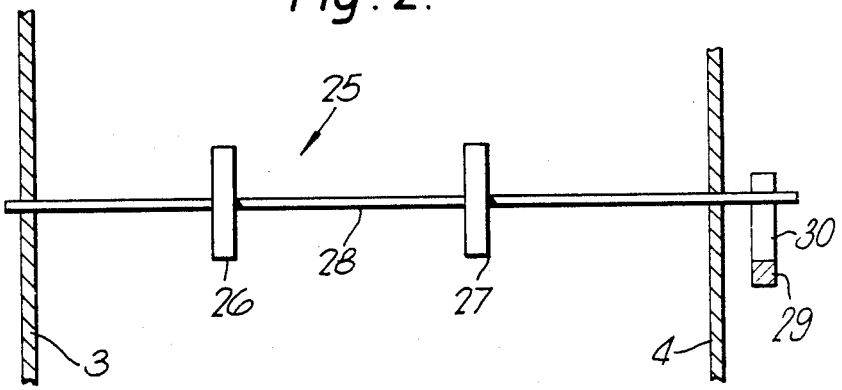
FIG. 2 is a plan of the diverter shown in FIG. 1.

The cash dispenser shown in FIG. 1 is for dispensing a single denomination of banknotes which are stored in a cassette 1 located between a pair of side walls 3, 4 (FIG. 2) and in a support 2 of the dispenser.

Banknotes are withdrawn from the cassette 1 by a pair of feed rollers 5 (FIGS. 1 and 3) mounted non-rotatably to a shaft 5'. Banknotes are fed by counter-clockwise rotation of the feed rollers 5 into a separation gap located between a pair of separation rollers 6, non-rotatably mounted on a shaft 6', which also rotate in a counter-clockwise direction and an associated counter-rotating roller 7. The purpose of these rollers 6, 7 is to ensure that only a single banknote is fed through the separation gap. As will be apparent from FIG. 1, only one roller of each pair of rollers 5, 6, 7 is illustrated.

The rollers 5 and 6 define a first transport system which is driven by a motor 8, mounted to the side plate 4, via a drive belt 9 entrained around a pulley 10 non-rotatably coupled with a drive gear 10' which engages drive gears 51, 52. The gear 51 is connected via a one-way (Torrington) clutch 51' with the shaft 5' which carries non-rotatably the rollers 5 while gear 52 is mounted to shaft 6' via a Torrington clutch (not shown). Thus counter-clockwise rotation of gear 51 (as seen in FIG. 1) causes counter-clockwise rotation of rollers 5 (arrow 100 in FIG. 3). Each of the rollers 5 and 6 is non-rotatably mounted on a respective shaft so that rotation of the rollers shown in FIG. 1 will be accompanied by corresponding rotation of the other ones of each pair.

The roller 7 is driven clockwise by a mechanical linkage from the second transport system.

Figure 3:
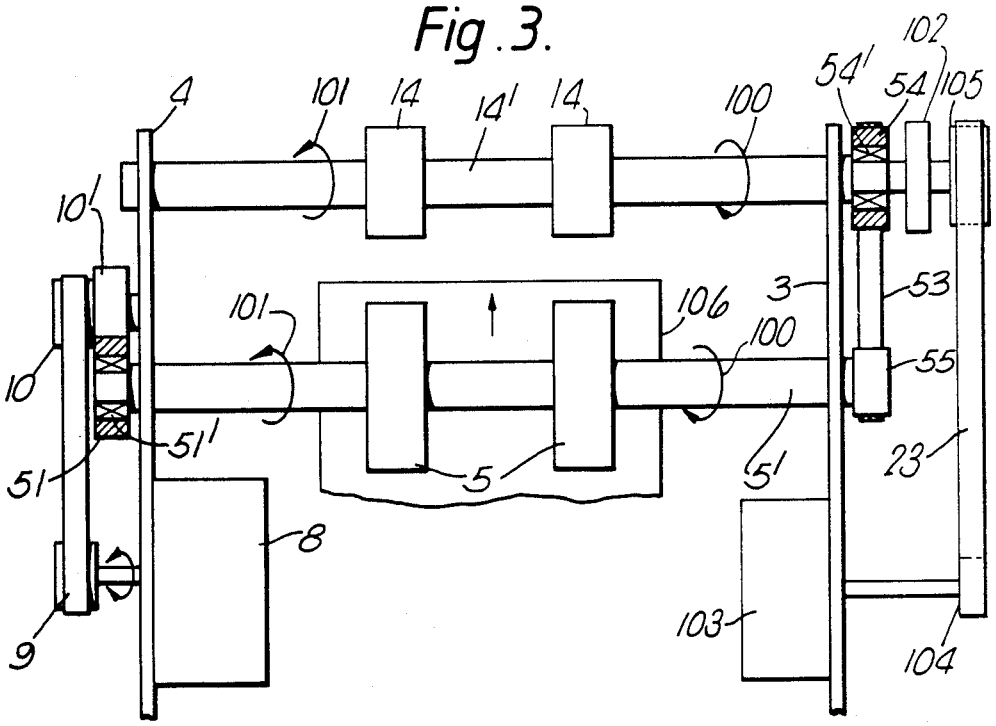
FIG. 3 is an end view of the dispenser with parts omitted for clarity.

For clarity rollers 6, 7 and the corresponding shafts have been omitted in FIG. 3.

A second transport system comprises a pair of belts 11, 12. The belt 11 is entrained around a set of rollers 13–17. the belt 12 is untrained around a set of rollers 18–22. Each of these rollers is non-rotatably mounted on a respective shaft.

The roller 14 is mounted on a shaft 14'. A gear 102 (FIG. 3) non-rotatably mounted on the shaft 14' engages an intermediate gear 50 which in turn engages a gear (not shown) mounted non-rotatably on a shaft 17' carrying rollers 17. The gear on shaft 17' engages another gear (not shown) non-rotatably mounted on a shaft 22' carrying rollers 22.

The drive shaft 14' is driven by a drive motor 103 mounted to the side wall 3. The motor 103 drives a pulley 104 around which is entrained a drive belt 23. The drive belt 23 is also entrained around a pulley 105 non-rotatably mounted to the shaft 14'. A drive belt 24 connects the drive shaft 14' with the shaft on which is mounted the rollers 13. Thus rotation of the shaft 14' causes rotation of the rollers 17 via intermediate gear 50 and hence rotation of rollers 22, and also rotation of rollers 13 and hence movement of the second transport system.

A diverter 25 is mounted between the first and second transport systems.

The diverter 25 comprises a pair of plates 26, 27 non-rotatably mounted on a shaft 28 extending between the side plates 3, 4. The diverter 25 is pivotable between a first position, shown by dashed lines 25' in FIG. 1, and a second position shown by solid lines in FIG. 1. The diverter is biased towards the second position, shown in FIG. 1, by a counterweight 29 mounted on a radius arm 30 non-rotatably connected to the shaft 28.

A third transport system is defined by rollers 31 forming respective nips with the idler rollers 22 from which they are friction driven.

Nips are also formed between the rollers 14 and respective rollers 32 gear driven from the gear 102 on shaft 14'.

The counter-rotating rollers 7 are driven via a yoke positioned about an eccentric mounted non-rotatably to the shaft carrying rollers 32. The yoke (not shown) is coupled to the shaft 7' via a Torrington clutch.

When a banknote 106 is fed by the rollers 5, 6, 7 towards the diverter 25, a leading edge of the banknote engages the guide plates 26, 27 and cause them to pivot in a clockwise direction, against the bias of the counterweight 29, towards the first position 25'. This will allow the banknote to be fed into the nip between the rollers 17, 22 where the banknote will be conveyed by the belts 11, 12. Once the trailing edge of the banknote has cleared the diverter, the diverter will return to its normal, second position, shown in solid lines in FIG. 1, under the influence of the counterweight 29. The sheet can then either be fed to a dispense outlet 33 or the second transport system motor 103 can be reversed, causing reverse movement of the second transport system, so that the note is fed back towards the diverter 25. Since, however, the diverter 25 is in its second position, the note will pass around the rollers 22 into a nip formed between the rollers 22 and the roller 31.

In order to detect the acceptability or otherwise of banknotes fed into the transport system, at least one of the pairs of rollers 17, 22 comprises part of a detection system. This may be of any conventional form with one of the rollers defining a datum, such as the roller 22, while radial movement of the other roller 17 in response to the passage of banknotes is monitored. An example of a suitable detection system is described in EP-A-0130804. This detection system will be coupled with a microcomputer 107 controlling operation of the apparatus which determines from signals representing the movement of the or each roller 17 whether a single note is being fed or overlapped sheets and will control the second transport system motor 103 accordingly.

In operation, a cassette 1 loaded with vertically oriented banknotes of a single denomination is positioned in the support 2. As the cassette is loaded into the support, a hollow lid 34 of the cassette is caused to rise up to the position shown in FIG. 1 where an entry portion of the lid is positioned to accept sheets fed by the third transport system. This results due to the engagement of part of the lid with an angled slot (not shown) in one of the walls 3, 4. An example of this arrangement is shown in EP-A-0180358. Also, as the cassette 1 is loaded into the support 2, another opening at the leading end of the cassette is opened so that the feed rollers 5 engage the leading banknote in the cassette.

When one or more banknotes is to be dispensed, the total amount to be dispensed is entered into the microcomputer 107 by the user in a conventional manner. The microcomputer 107 determines the number of banknotes required for that dispense operation. The microcomputer 107 then activates both motors 8, 103, the motor 8 causing counter-clockwise rotation of rollers 5 to draw a single sheet 106 upwardly out of the cassette 1 into the separation gap between the rollers 6, 7. As previously described, the banknotes are then fed past the diverter 25 into the second transport system. The detection system then determines whether a single banknote has been correctly fed or whether an incorrect feed has occurred. In the former case, the second transport system motor 103 is allowed to continue to operate and the banknote is conveyed to the dispense outlet 33 where it may be removed from the apparatus.

As soon as the detection system determines that a note is being fed by the second transport system, the microcomputer 107 causes the motor 8 to stop thereby preventing any further notes being withdrawn from the cassette. However, when a note is still in the first transport system when it is fed by the second transport system, the one-way clutch mounting of gear 51 to feed rollers 5 and of gear 52 to separation rollers 6 allows the feed rollers 5 and separation rollers 6 to over run and thus reduce the risk of notes tearing. Once a correctly fed banknote has been dispensed past the detection system, the microcomputer 107 decides whether any further banknotes are required in the transaction and if they are, restarts the motor 8 so that a further sheet is withdrawn from the cassette 1. During this period the second transport system will continuously rotate.

If the detection system determines that an unacceptable feed has occurred, for example two banknotes have been fed into the second transport system, the microcomputer 107 causes the second transport system to reverse by reversing the second transport system motor 103 thereby causing the banknote 106 to return through the nips defined by the rollers 17, 22 past the diverter 25 which has returned to its second position and into the nips defined by the rollers 22, 31. These banknotes are then fed into the hollow lid 34 of the cassette which defines a dump.

In order that banknotes are not inadvertently dispensed through the outlet 33 when an unacceptable feed has taken place, the length of the feed path of the second transport system between the rollers 17, 22 and the dispense outlet 33 is made to be at least equal to twice the length of the longest banknote which is to be fed where "length" is the dimension in the feed direction.

The need for the separation gap defined between the rollers 6 and counter-rotating roller 7 is due to the fact that the action of the rollers 5 can cause more than one note to be drawn out of the cassette 1. Only one of the notes is allowed to pass through the separation gap leaving one or more "shingled" notes protruding from the cassette. This is undesirable since when the cassette is removed from the housing, the shingled notes may still protrude preventing closure of the lid 34. To prevent this, an anti-shingle mechanism is provided comprising a belt 53 entrained around pulleys 54, 55 mounted on the shafts 14', 5' respectively. The pulley 55 is non-rotatably mounted to shaft 5' while the pulley 54 is mounted via a one-way Torrington clutch 54' to the shaft 14'. this one-way clutch 54' is arranged so that when the second motor 103 rotates the rollers 14 in the dispense direction 100 (anti-clockwise) the one-way clutch 54' slips and the pulleys 54, 55 are not driven.

When the second motor 103 rotates the drive rollers 14 in the reject/purge (reverse) direction (clockwise in FIG. 1) the one-way clutch 54' engages so that drive is transmitted via the pulleys 54, 55 to the shaft 5' and hence to the rollers 5 which rotate in the direction of arrow 101. The rollers 5 thus rotate in a clockwise direction tending to push shingled notes back into the cassette 1. This reverse operation of the rollers 5 will cause reverse rotation of the pulley 10 and hence tend to drive the motor 8 in a reverse direction. Although in some circumstances this may be acceptable, preferably, the motor 8 is also caused to rotate in its reverse direction to reduce the load on the second motor.

It is particularly convenient if the microcomputer 107 is programmed to cause a purge operation to take place (ie. reverse movement of the second transport system) at the end of each dispense operation. When the cassette is removed from the apparatus, the lid 34 and the dispense opening are automatically closed.

We claim:

1. Sheet feeding apparatus comprising a sheet store having a lid in which is provided a sheet dump; first transport means operable in a forward direction to withdraw sheets from said sheet store; second transport means arranged to receive sheets from said first transport means and operable in a forward direction to feed said sheets to an output position, said second transport means being reversible to feed sheets to said dump provided in said lid of said sheet store; drive means for driving said first and second transport means; detection means for detecting the passage of sheets; and control means for controlling operation of the apparatus during a sheet dispense operation so as to cause said first transport means to withdraw a single sheet from said store, for monitoring said detection means to determine whether a single sheet has been correctly fed, and for causing said second transport means to feed correctly fed sheets in said forward direction to said output position, and to feed incorrectly fed sheets in said reverse direction to said dump while preventing further sheets from being fed to the second transport means during said reverse movement of said transport means.

2. Apparatus according to claim 1, wherein said first transport means comprises at least one movable friction surface for engaging a leading sheet in said store and for withdrawing said sheet from said store when said first transport means is operated in said forward direction.

3. Apparatus according to claim 2, wherein said movable friction surface is defined by the surface of a roller.

4. Apparatus according to claim 1, wherein said drive means comprises two drive motors connected to said first and second transport means respectively.

5. Apparatus according to claim 1, wherein said control means causes reverse movement of said second transport means at the end of a dispense operation.

6. Apparatus according to claim 1, further comprising a sheet store housing adapted to cause a dispense outlet of a store to open when said store is moved into said housing and to close when said store is withdrawn from said housing.

7. Apparatus according to claim 1, further comprising diverting means, cooperating with said second transport means to assist sheets fed by reverse movement of said second transport means to pass to said dump.

8. Apparatus according to claim 1 further including banknotes loaded in said sheet store as said sheets.

* * * * *